US007548723B2

(12) United States Patent
Kang

(10) Patent No.: US 7,548,723 B2
(45) Date of Patent: Jun. 16, 2009

(54) PAPER DELIVERING DEVICE AND IMAGE FORMING APPARATUS

(75) Inventor: Hoon Kang, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 459 days.

(21) Appl. No.: 11/433,568

(22) Filed: May 15, 2006

(65) Prior Publication Data

US 2006/0280521 A1 Dec. 14, 2006

(30) Foreign Application Priority Data

Jun. 1, 2005 (KR) ..... 10-2005-0046790

(51) Int. Cl.
*G03G 15/00* (2006.01)

(52) U.S. Cl. ..... 399/405; 399/21; 399/124; 399/125; 399/407; 271/256; 271/264; 271/272; 271/273; 271/274; 400/624; 400/625

(58) Field of Classification Search ..... 399/21, 399/124, 125, 405, 407; 400/624, 625; 271/272, 271/273, 274, 256, 264
See application file for complete search history.

(56) References Cited

U.S. PATENT DOCUMENTS 5,991,570 A * 11/1999 Haga et al. ..... 399/114
6,167,222 A 12/2000 Lee
6,328,298 B1 12/2001 Suzuki et al.
2005/0018234 A1 1/2005 Lee

FOREIGN PATENT DOCUMENTS

| | | |
|---|---|---|
| EP | 0 448 022 | 3/1991 |
| JP | 8-314217 | 11/1996 |
| KR | 2005-11070 | 1/2005 |

* cited by examiner

*Primary Examiner*—Ren Yan
*Assistant Examiner*—Andy L Pham
(74) *Attorney, Agent, or Firm*—Stein McEwen, LLP

(57) ABSTRACT

A paper delivering device to deliver printing paper, including: a lower frame; an upper frame rotatably coupling with the lower frame by a hinge part and rotating between a driving position in which the upper frame is disposed to parallel with respect to the lower frame with putting a delivery pathway of the printing paper between there and an opened position where the upper frame is spaced from the driving position; an upper delivery roller disposed on a lateral surface facing to the lower frame in the upper frame; a plate, interposed between the lower frame and the upper frame, to be detachable from the lower frame in a surface direction of the printing paper; and a lower delivery roller disposed on a lateral surface facing the upper frame of the plate and delivering the printing paper by oppositely rotating with the upper delivery roller when the plate is disposed at the lower frame.

16 Claims, 4 Drawing Sheets

PAPER DELIVERING DEVICE AND IMAGE FORMING APPARATUS

CROSS-REFERENCE TO RELATED APPLICATION

This application claims the benefit of Korean Application No. 2005-46790, filed Jun. 1, 2005, in the Korean Intellectual Property Office, the disclosure of which is incorporated herein by reference.

BACKGROUND OF THE INVENTION

1. Field of the Invention

An aspect of the present invention relates to an image forming apparatus, and, more particularly, to an image forming apparatus which efficiently removes a paper jam from a space point of view.

2. Description of the Related Art

Conventionally, an image forming apparatus includes a feeder, an image forming part and a discharge part. The feeder supplies printing paper to the image forming part, and then the image forming part forms an image in the printing paper in a predetermined method. The discharge part receives the printing paper formed with the image from the image forming part and discharges the printing paper to the outside. The image forming part forms a latent image using an electric potential difference and selectively supplies a developer to the latent image and develops the latent image. Then, the image forming part transfers the latent image to the printing paper to form the image.

As the image forming apparatus begins to operate at high speeds and with high operations, the image forming apparatus requires various discharge options, such as a sort discharge option. Therefore, a special discharge device, which is detachably provided in a main body of the image forming apparatus to accomplish various discharge options, that is, a finisher, is widely used. The image forming apparatus widely employs an internal tray type, which is detachable to the finisher and is not projected from an outer line of a main body to the outside and is provided with a predetermined storage space in the main body to discharge and store the printing paper into the storage space. The internal tray type allows the main body to be thin and compact and uses space efficiently.

Where the finisher is mounted in the image forming apparatus of the internal tray type of image forming apparatus, a paper delivering device is disposed in the storage space. The paper delivering device is interposed between the image forming apparatus and the finisher to receive the printing paper from the image forming apparatus to deliver the paper to the finisher.

FIG. 1 is a front view illustrating a conventional image forming apparatus, and FIG. 2 is a side view illustrating the image forming apparatus of FIG. 1. As shown therein, the image forming apparatus 100 includes a main body part 110 of the internal tray type of image forming apparatus and a reader 120. The main body part 110 includes an image forming part 112, a feeder cassette 114, a discharge roller 116, and a discharge storage part 118. The reader 120 reads a document image and transfers document image information to the image forming part 112.

When the image forming part 112 receives the printing paper from the feeder cassette 114, the image forming part 112 forms the image on the printing paper according to a predetermined image forming process. The printing paper formed with the image is discharged by the discharge roller 116.

Where the finisher is not mounted, generally, the paper delivering device 140 may be not mounted as well. Here, the discharge roller 116 discharges and stores the printing paper to the discharge storage part 118 provided between the main body part 110 and the reader 120. Where the finisher 130 is mounted in the image forming apparatus 100, the paper delivering device 140 mounted in the discharge storage part 118 receives the printing paper from the discharge roller 116 of the main body part 110 to deliver the printing paper to a paper receiver 132 of the finisher 130. The finisher 130 discharges the received printing paper.

The paper delivering device 140 includes an upper frame 142 and a lower frame 144. The upper frame 142 and the lower frame 144 respectively include an upper delivery roller 143 and a lower delivery roller 145, which are opposite to each other and which create a process pathway of the printing paper (P) therebetween. The upper delivery roller 143 and the lower delivery roller 145 rotate oppositely with respect to each other so as to deliver the printing paper (P) from the discharge roller 116 to the paper receiver 132. The upper delivery roller 143 and the lower delivery roller 145 are rotatably coupled by a hinge part 146.

Where the printing paper is hooked in the paper delivering device 140, such that a paper jam occurs, a user rotates the upper frame 142 using the hinge part 146 and then removes the exposed jam. When the jam removal operation is finished, the upper frame 142 is rotated to an original position, which is substantially parallel with the lower frame 144. Accordingly, the upper delivery roller 143 and the lower delivery roller 145 are oppositely positioned with each other so as to be positioned to transfer the printing paper (P).

However, during the operation described above, the user should rotate the upper frame 142 sufficiently so as to be able to check and remove the paper jam. Thus, the paper delivering device 140 requires a sufficient amount of rotating space for the upper frame 142 to rotate toward an upper side of the upper frame 142 (i.e., a rotating space of approximately 100 mm in height). The reader 120 is sufficiently spaced from the upper frame 142 to ensure that the rotating space of the upper frame 142 is available. However, when the user lifts up the reader 120, the reader 120 exceeds a desired height in which the user disposes the document paper on the reader 120 to use (i.e., 900~1030 mm) and causing an inconvenience to the user. Further, the user may lower the height of the main body part 110 to ensure the rotating space of the upper frame 142 is available. However, here, a loading height of the printing paper of the feeder cassette 114 should be restricted. Particularly, where the paper jam occurs in a process of using printing paper of a small size, to check the printing paper, a rotating angle of the upper frame 142 is enlarged, so as to ensure that there may be enough space for the rotation may be difficult.

SUMMARY OF THE INVENTION

Accordingly, an aspect of the present invention provides a paper delivering device and an image forming apparatus that allows for an efficient correction of a paper jam.

The foregoing and/or other aspects of the present invention are also achieved by providing a paper delivering device to deliver printing paper, comprising: a lower frame; an upper frame, rotatably coupled with the lower frame by a hinge part, to rotate between a driving position, in which the upper frame is disposed in parallel with respect to the lower frame so as to define a delivery pathway of the printing paper, and an opened position, in which the upper frame is spaced from the lower frame; an upper delivery roller disposed on a lateral surface of the upper frame that faces the lower frame; a plate, interposed between the lower frame and the upper frame, to be detachable from the lower frame in a direction parallel with a surface of the printing paper; and a lower delivery roller disposed on a lateral surface of the plate that faces the upper frame to deliver the printing paper along the delivery pathway by rotating in a direction opposite that of the upper delivery roller when the plate is disposed at the lower frame.

The hinge part comprises an axis that is parallel with a delivery direction of the printing paper, and the plate is detachable in a direction that is perpendicular with respect to the delivery direction of the printing paper.

The paper delivering device further comprises a rail part, which is interposed between the lower frame and the plate, to allow the plate to detachably slide toward the lower frame. The paper delivering device further comprises a locking part having a stopping groove, which is provided in one of the lower frame and the plate, and a stopping protrusion, which is provided in the other one of the lower frame and the plate and which is detachable from the stopping groove, to prevent the plate from moving when the plate is disposed at the lower frame. The paper delivering device further comprises an elastic member, which is interposed between the plate and the lower frame, and which presses the plate in a direction sufficient to separate the plate from the lower frame.

The upper frame comprises a stopping releasing part to separate the stopping protrusion from the stopping groove when the upper frame is rotated from the driving position to the opening position.

The paper delivering device further comprises a frame sensor to sense that the upper frame is positioned at the driving position, and a plate sensor to sense that the plate is disposed at the lower frame.

The paper delivering device further comprises a supporting frame positioned at an upper side of the upper frame, and position maintaining parts, which are disposed at the upper frame and the supporting frame, respectively, to oppose each other and to support the upper frame when the upper frame is positioned at the opening position.

The foregoing and/or other aspects of the present invention are also achieved by providing an image forming apparatus comprising a paper delivering device described above.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
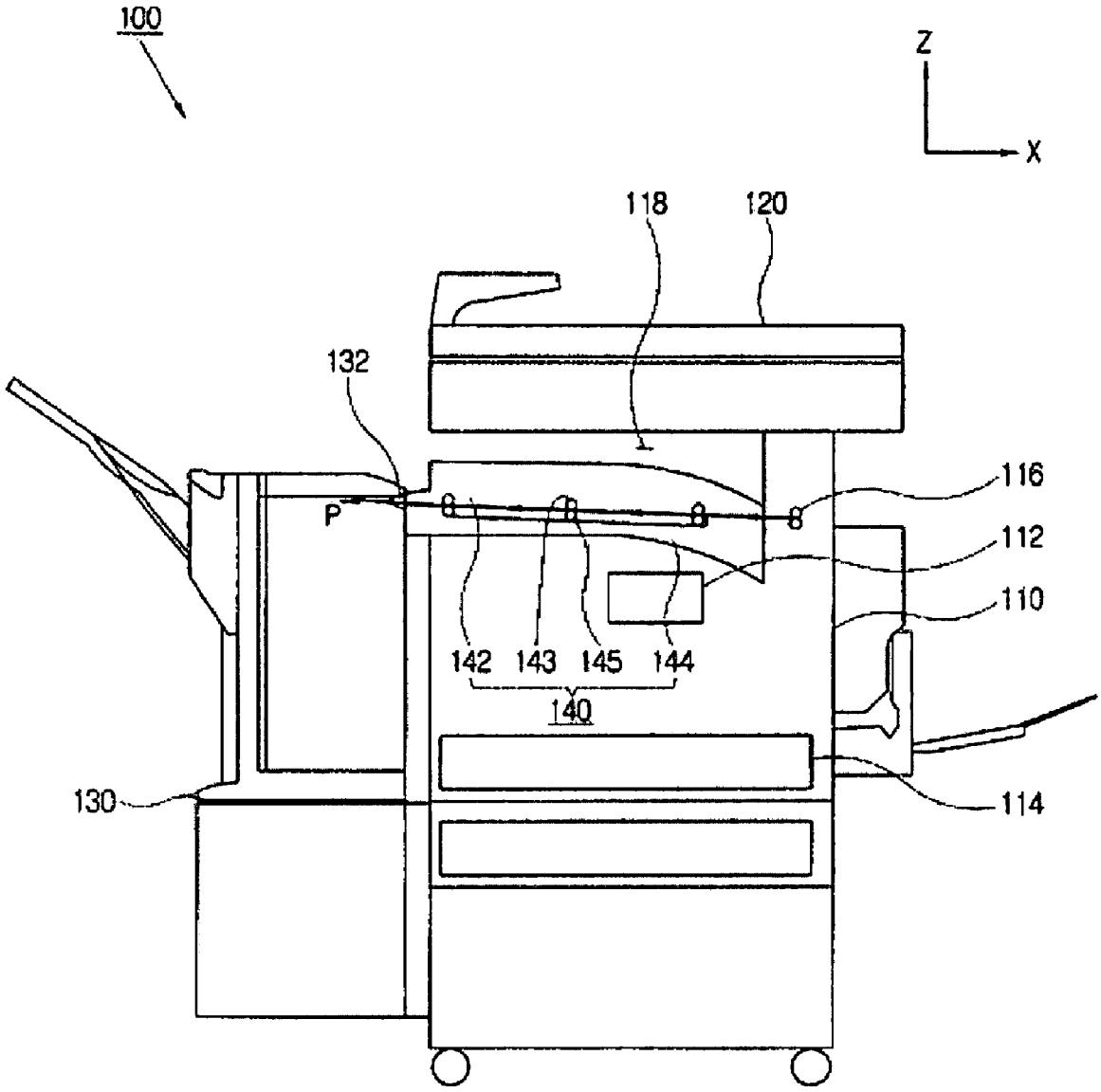
FIG. 1 (PRIOR ART)
FIG. 1 is a front view illustrating a conventional image forming apparatus.
Figure 2:
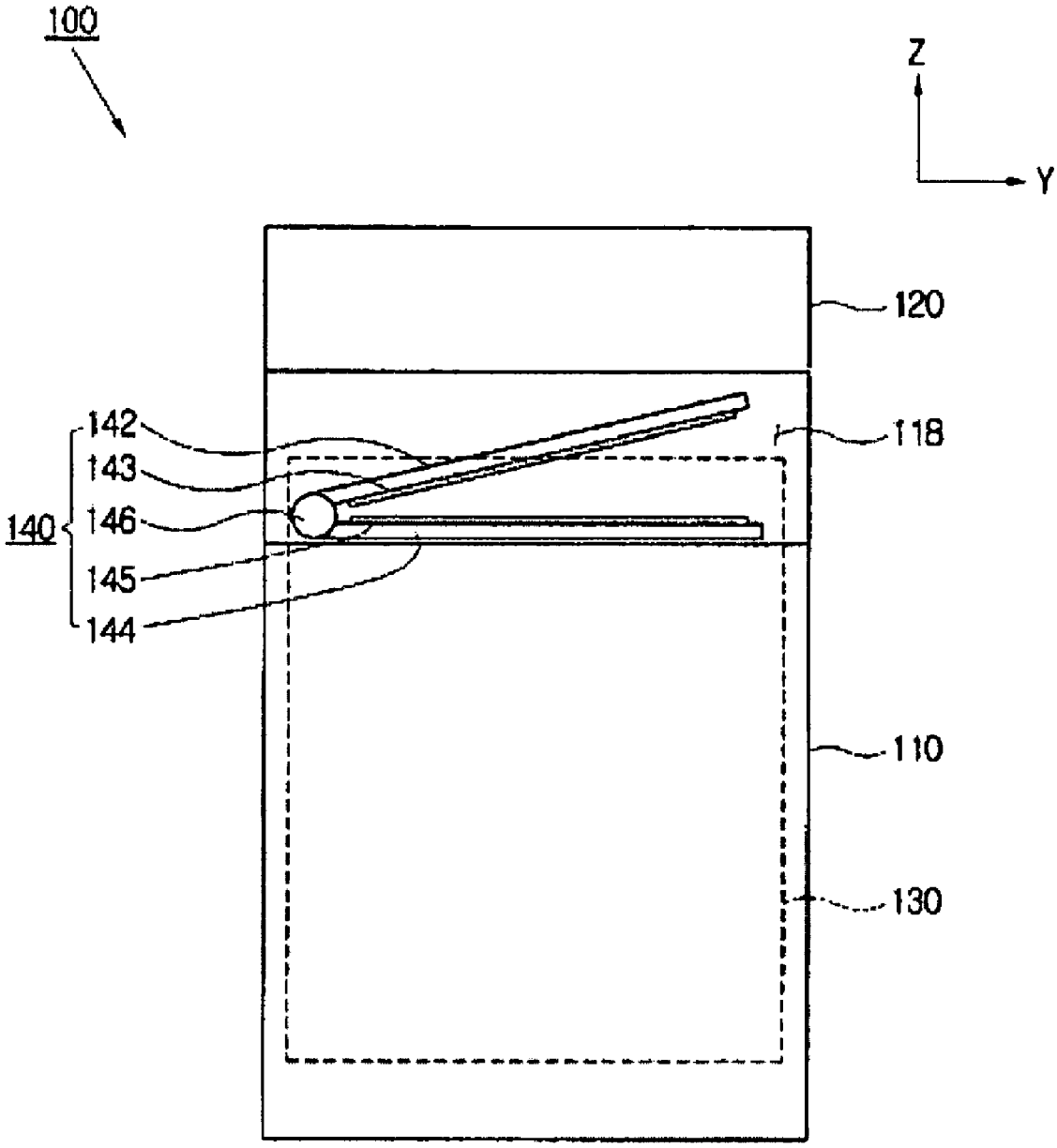
FIG. 2 (PRIOR ART)
FIG. 2 is a side view illustrating the image forming apparatus of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
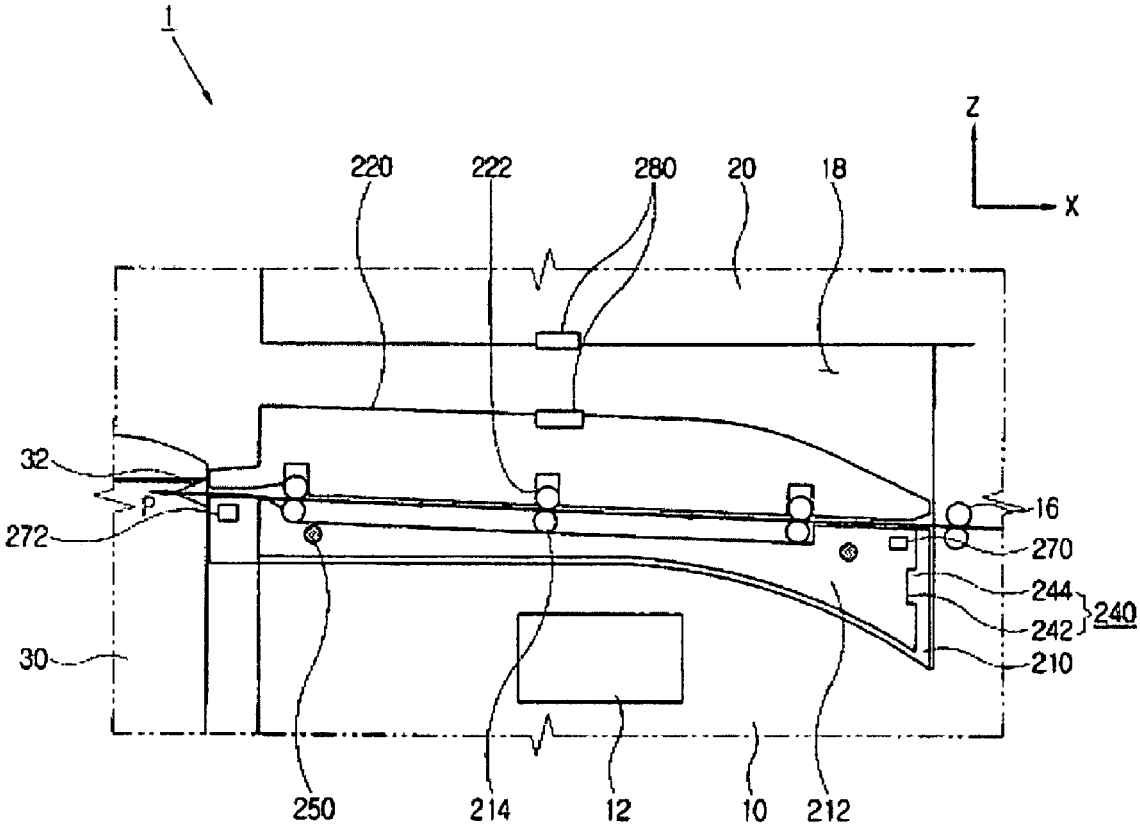
FIG. 3 is a front view illustrating a paper delivering device according to an embodiment of the present invention.
Figure 4:
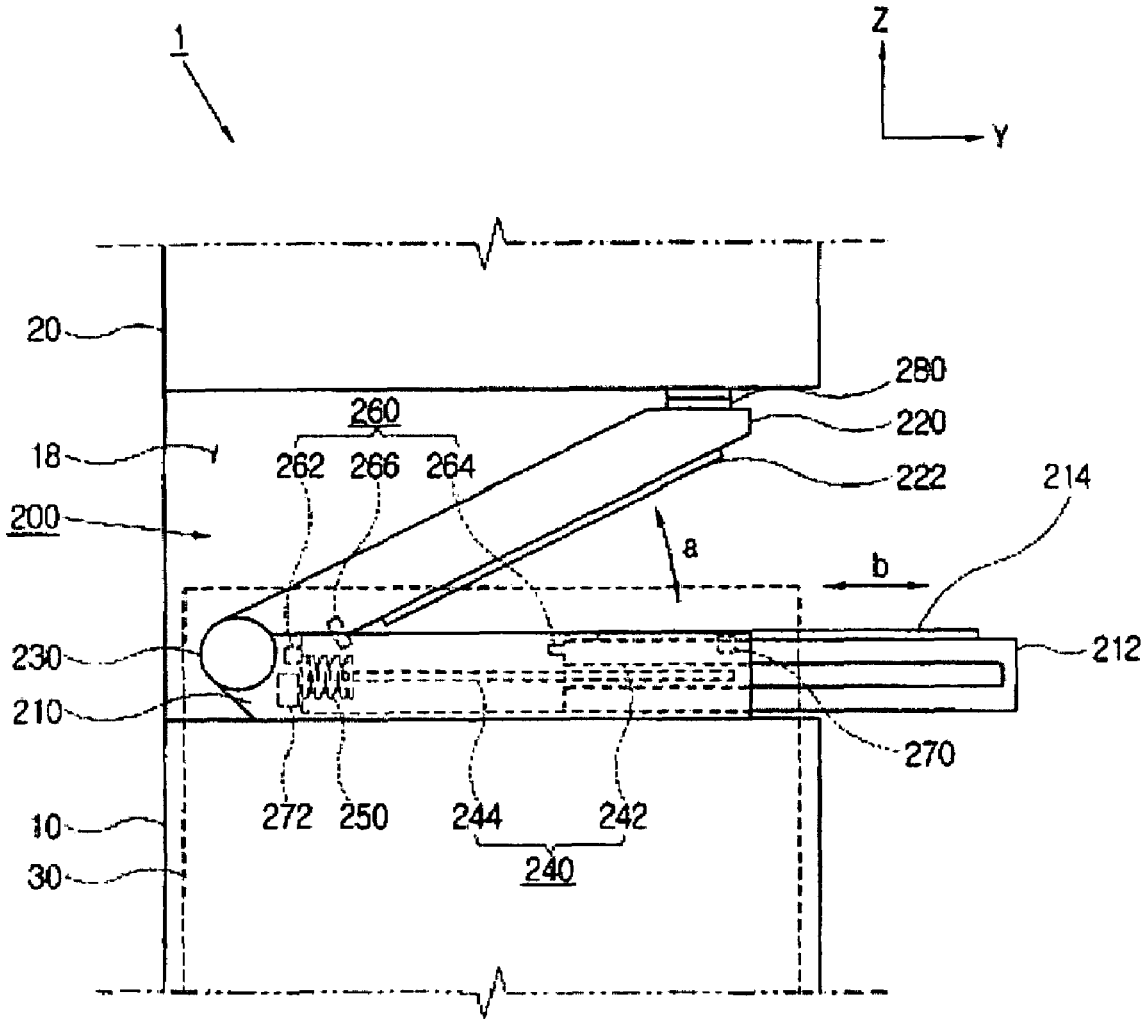
FIG. 4 is a side view illustrating the paper delivering device of FIG. 3.

FIG. 3 is a front view illustrating a paper delivering device according to an embodiment of the present invention, and FIG. 4 is a side view illustrating the paper delivering device of FIG. 3. As shown therein, an image forming apparatus 1 includes a main body part 10, a reader 20, a discharge storage part 18, a finisher 30, and a paper delivering device 200.

The main body part 10 includes an image forming part 12 to receive printing paper from a feeder cassette (not shown) and form an image on the image paper through an image forming process, and a discharge roller 16 to receive the printing paper from the image forming part 12 and discharge the printing paper toward the discharge storage part 18. The image forming part 12 includes an opto photo-organic conductor (OPC) (not shown), scans light to the OPC (not shown) to form a latent image, applies a developer to the formed latent image, and transfers a developed image formed at the OPC (not shown) to the printing paper to form the image. The main body part 10 includes a fixing part (not shown), which is disposed on a delivery pathway of the printing paper between the image forming part 12 and the discharge roller 16, and fixes the developer applied to the printing paper.

The reader 20 is disposed at an upper side of the main body part 10, and reads document paper to acquire document image information. The reader 20 supplies the document image information to the image forming part 12 to get a printing image that is identical with the image of the document paper.

The image forming apparatus 1 includes the discharge storage part 18 which is not projected to the outside thereof and which is provided inside of an outer line of the apparatus (i.e., an internal tray type). The discharge storage part 18 is formed between the main body part 10 and the reader 20 and stores the printing paper discharged by the discharge roller 16. The discharge storage part 18 stores the printing paper formed with the image in a state that neither the discharge storage part 18 nor the printing paper is projected to the outside of the image forming apparatus 1. As such, the image forming apparatus 1 does not take up an unnecessarily large amount of space. Further, the discharge storage part 18 is coupled with the finisher 30 having various discharging options, such as a sort discharge, to enhance a convenience of the apparatus to the user.

The finisher 30 is detachable from the image forming apparatus 1 and receives the printing paper, formed with the image, by being coupled with the image forming apparatus 1 to accomplish the various discharge options. The image forming apparatus 1 discharges and stores the printing paper in the discharge storage part 18 where the finisher 30 is not coupled to the image forming apparatus 1. Further, where the finisher 30 is coupled to the image forming apparatus 1, the paper delivering device 200 is disposed at the discharge storage part 18 and delivers the printing paper from the discharge roller 16 to the paper receiver 32 of the finisher 30.

The paper delivering device 200 includes a lower frame 210, an upper frame 220 and a plate 21. The lower frame 210 is disposed at the discharge storage part 18. The upper frame 220 is rotatably coupled with the lower frame 210 by the hinge part 230 and rotates between a driving position in which the upper frame 220 is disposed in parallel with respect to the lower frame 210. The delivery pathway of the printing paper is generated between the upper frame 220 and the lower frame 210 and an opening position is spaced from the driving position.

The upper frame 220 rotates at a predetermined rotating angle within a discharge storage space of the discharge storage part 18, which is provided between the main body part 10 and the reader 20. An axis of the hinge part 230 is parallel to a direction in which the printing paper is delivered. The upper frame 220 rotates in a circumferential direction (i.e., the "a" direction shown in FIG. 4) with respect to the axis of the delivery direction of the printing paper. Therefore, when the upper frame 220 is positioned at the opening position, an upper surface of the lower frame 210 may be directly exposed to the user, without obstructing a view of the finisher 30 or the main body part 10.

It is noted that the description of the upper frame 220 and an operation thereof is merely exemplary and that other embodiments are possible. For example, the upper frame 220 may be lifted from the lower frame 210 without a need for a hinge. In addition, where the upper frame 220 is lifted from the lower frame 210, a vertical track (not shown) may be provided to aid in the lifting, although such an addition is not necessary. According to an additional embodiment, a system of levers and/or an electric motor may be provided to automatically rotate and/or lift the upper frame 220 from the lower frame 210.

The upper frame 220 supports an upper delivery roller 222. The upper delivery roller 222 is disposed on a lateral surface, which faces the lower frame 210, of the upper frame 220, and delivers the printing paper together with a lower delivery roller 214 along the delivery pathway (P). The upper delivery roller 222 engages with the lower delivery roller 214 when the upper frame 220 is positioned at the driving position, and is separated from the lower delivery roller 214 when the upper frame 220 is positioned at the opening position.

The plate 212 is interposed between the lower frame 210 and the upper frame 220, and is detachable from the lower frame 210 along a direction that is parallel to a surface of the printing paper. In other words, the plate 212 is detachable along the planar direction of the printing paper delivered between the lower frame 210 and the upper frame 220 and in a vertical direction (i.e., the "b" direction shown in FIG. 4) with respect to the delivery direction of the printing paper. Therefore, the user may easily approach the plate 212 since the plate 212 is detachable in a direction such that the plate 212 is not obstructed from view by the main body part 10 or the finisher 30.

The plate 212 supports the lower delivery roller 214. When the plate 212 is mounted to the lower frame 210, the lower delivery roller 214 is disposed on a lateral surface which faces the upper frame 220 in the plate 212, and delivers the printing paper along the plate 212 by rotating oppositely with respect to the rotation of the upper delivery roller 222. The lower delivery roller 214 engages the upper delivery roller 222 when the upper frame 220 is positioned at the driving position and the plate 212 is positioned at a position in which the lower frame 210 is disposed underneath the plate 212. The lower delivery roller 214 is rotated in a direction that is opposite that of the upper delivery roller 222 so as to deliver the printing paper along the delivery pathway (P) of the printing paper.

At least one of the upper delivery roller 222 and the lower delivery roller 214 rotates by receiving a driving power from a driving part (not shown). When the lower delivery roller 214 is driven by the driving power from the driving part (not shown), the upper delivery roller 222 is passively rotated by the rotating of the lower delivery roller 214. The driving part (not shown) receives the driving power from the main body part 10 or the finisher 30 to transfer the driving power to the lower delivery roller 214. Further, the driving part (not shown) receives the driving power by a driving motor (not shown) which is respectively provided in the paper delivering device 200.

The plate 212 is detachable from the lower frame 210 while the lower delivery roller 214 is connected to or separated from the driving part (not shown). The driving part and the lower delivery roller 214 may have a conventional detachable driving transfer coupling such as a double coupling. When the plate 212 is disposed at the lower frame 210, the lower delivery roller 214 receives rotating power from the driving part to deliver the printing paper along with the upper delivery roller 222.

The paper delivering device 200 includes a rail part 240 which is interposed between the lower frame 210 and the plate 212 and allows the plate 212 to detachably slide toward the lower frame 210. The rail part 240 includes a rail groove 242 formed at the plate 212, and a rail projection 244, which is formed in a position corresponding to the rail groove 242 of the lower frame 210 and which is movably accommodated into the rail groove 242. Accordingly, as the rail projection 244 is moved in the rail groove 242, the rail part 240 induces the plate 212 to detachably slide with respect to the lower frame 210. The rail part 240 includes a roller (not shown), which is interposed between the rail groove 242 and the rail projection 244, to allow the plate 212 to slide smoothly.

Alternatively, the rail groove 242 may be formed at the lower frame 210, and the rail projection 244 may be formed at the plate 212. Further, the rail part 240 may be positioned at other positions such as a bottom of the plate 212 as well as a lateral surface of the plate 212. Yet another possible embodiment exists in which the plate 212 is slid and detachable to the lower frame 210 without the rail part 240.

In addition, the rail part 240 includes a stopper (not shown) which is formed at an end of a side of at least one of the rail groove 242 and the rail projection 244. Such a stopper prevents the plate 212 from being separated from the lower frame 210.

As shown in FIG. 4, the paper delivering device 200 comprises a locking part 260. The locking part 260 is interposed between the plate 212 and the lower frame 210 and fixes a position of the plate 212 when the plate 212 is disposed at the lower frame 210 by preventing the plate 212 from moving. The locking part 260 releases a positional fixation of the plate 212 when the plate 212 is to be detached from the lower frame 210 so as to allow the plate 212 to move freely.

The locking part 260 comprises a stopping groove 262 formed at the lower frame 210, and a stopping protrusion 264 to be inserted into the stopping groove 262. The stopping protrusion 264 is detachable from the stopping groove 262 when the plate 212 is to be detached from the lower frame 210. Alternatively, the stopping groove 262 may be formed at the plate 212 and the stopping protrusion 264 may be formed at the lower plate 212.

The paper delivering device 200 includes an elastic member 250. The elastic member 250 is interposed between the plate 212 and the lower frame 210 and presses the plate 212 in a direction that is parallel to the direction along which the plate 212 moves when the plate 212 is detached from the lower frame 210.

When the plate 212 is disposed at the lower frame 210, the elastic member 250 is pressurized by the plate 212, which is supported by a coupling of the stopping groove 262 and the stopping protrusion 264. As such, elastic energy is stored in the elastic member 250. When the stopping protrusion 264 is separated from the stopping groove 262, the plate 212 is moved by the elastic member 250 upon the release of the accumulated elastic energy. In practice, the elastic member 250 presses the plate 212 so that the plate 212 is moved about 10~20 cm. Therefore, the user may easily grip the plate 212 such that the user may complete the plate 212 sliding operation and easily checking the paper jam formed at the plate 212. In embodiments of the invention, the elastic member 250 may be a conventional spring such as a coiled spring, a leaf spring, or the like.

The upper frame 220 comprises a stopping releasing part 266, which separates the stopping protrusion 264 from the stopping groove 262 when the upper frame 220 is rotated from the driving position to the opening position. The stopping releasing part 266 is disposed at a position corresponding to the locking part 260 of the upper frame 220. When the user rotates the upper frame 220 in an opening direction, the stopping releasing part 266 separates the stopping protrusion 264 from the stopping groove 262. As a result, the elastic member 250 moves the plate 212 in the detaching direction. Therefore, the rotation of the upper frame 220 is coupled to the movement of the plate 212.

Alternatively, the stopping protrusion 264 is separated from the stopping groove 262 by devices other than the stopping releasing part 266 as well. Similarly, in another embodiment of the invention, the user directly separates the stopping protrusion 264 from the stopping groove 262 after rotating the upper frame to an open position, without a need for the stopping releasing part 266. The stopping protrusion 264 may comprise a handle (not shown) that the user grips.

A frame sensor 270 senses that the upper frame 220 is located in the driving position. Where the upper frame 220 rotates from the driving position, the frame sensor 270 transfers rotational information to a controller (not shown). Then, the controller (not shown) stops the driving of the lower delivery roller 214 or the upper delivery roller 222. Where the upper frame 220 rotates to return in the driving position, the frame sensor 270 transfers positional information of the upper frame 220 to the controller (not shown), and the controller (not shown) allows the driving of the lower delivery roller 214 or the upper delivery roller 222.

A plate sensor 272, shown in FIG. 3, senses that the plate 212 is disposed at the lower frame 210. The plate sensor 272 transfers the information that the plate 212 is not disposed at the lower frame 210 to the controller (not shown) when the plate 212 is detached from the lower frame 210 or when the plate 212 is not disposed at the lower frame 210 so that the lower delivery roller 214 smoothly receives or so that the lower delivery roller is prevented from receiving the driving power from the driving part (not shown). Therefore, the controller (not shown) stops the driving of the lower delivery roller 214 or the upper delivery roller 222. The paper delivering device 200 comprises a paper jam sensor (not shown), which senses the paper jam. If the paper jam occurs, the paper jam sensor (not shown) transfers the paper jam information to the controller (not shown) and the controller (not shown) stops the driving of the paper delivering device 200.

Position maintaining parts 280 are disposed at the upper frame 220 and a supporting frame 20 respectively to oppose each other and to support the upper frame 20 when the upper frame 220 is opened. The supporting frame 20 is spaced from an upper side of the upper frame 220 by a predetermined distance that provides for a rotating space in which the upper frame 220 may rotate. The supporting frame 20 is spaced from the upper frame 220 so that the upper frame 220 may rotate upwards by approximately 10~20 circumferential cm. The supporting frame 20 may be a conventional frame supporting the upper frame 220. In an embodiment of the invention, the supporting frame 20 also comprises the reader 20.

The position maintaining parts 280 allow the upper frame 220 to be supported in the opened position by coupling with each other where the user rotates the upper frame 220 to the opening position. Therefore, the position maintaining parts 280 make it unnecessary for the user to directly support the upper frame 220, thereby enhancing convenience of the user. The position maintaining parts 280 are easily separated from each other by a predetermined external force. If the user rotates the upper frame 220 to return the upper frame 220 to the driving position, the position maintaining parts 280 are separated from each other to allow the upper frame 220 to rotate freely. The position maintaining parts 280 may be a conventional coupling device such as a magnetic, a fabric hook, or the like.

An operation of the paper delivering device according to an embodiment of the present invention will be described with reference to FIGS. 3 and 4. The upper frame 220 is initially positioned at the driving position and the upper delivery roller 222 and the lower delivery roller 214 rotate oppositely with each other and receive the printing paper from the discharge roller 16 of the main body part 10 to deliver the printing paper to the paper receiver 32 of the finisher 30.

When the printing paper becomes jammed in the paper delivering device 200, the user rotates the upper frame 220 to an open position. As a result, the stopping releasing part 266 separates the stopping protrusion 264 from the stopping groove 262, and the spring member 250 moves the plate 212. The user moves the plate 212, which is then exposed to the outside of the apparatus, further, and confirms the position of paper jam generation so as to be able to remove the paper jam. The user then returns the plate 212 to the lower frame 210 and rotates the upper frame 220 toward the lower frame 210. The paper delivery of the paper delivering device 200 then resumes.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A paper delivering device to deliver printing paper, comprising:

a lower frame;

an upper frame, rotatably coupled with the lower frame by a hinge part, to rotate between a driving position, in which the upper frame is disposed in parallel with respect to the lower frame so as to define a delivery pathway of the printing paper, and an opened position, in which the upper frame is spaced from the lower frame;

an upper delivery roller disposed on a lateral surface of the upper frame that faces the lower frame;

a plate, interposed between the lower frame and the upper frame, to be detachable from the lower frame in a direction parallel with a surface of the printing paper; and a lower delivery roller disposed on a lateral surface of the plate that faces the upper frame to deliver the printing paper along the delivery pathway by rotating in a direction opposite that of the upper delivery roller when the plate is disposed at the lower frame.

2. The paper delivering device according to claim 1, wherein the hinge part comprises an axis that is parallel with a delivery direction of the printing paper, and the plate is detachable in a direction that is perpendicular with respect to the delivery direction of the printing paper.

3. The paper delivering device according to claim 2, further comprising a rail part, which is interposed between the lower frame and the plate, to allow the plate to detachably slide toward the lower frame.

4. The paper delivering device according to claim 3, further comprising a locking part having a stopping groove, which is provided in one of the lower frame and the plate, and a stopping protrusion, which is provided in the other one of the lower frame and the plate and which is detachable from the stopping groove, to prevent the plate from moving when the plate is disposed at the lower frame.

5. The paper delivering device according to claim 4, further comprising an elastic member, which is interposed between the plate and the lower frame, and which presses the plate in a direction to separate the plate from the lower frame.

6. The paper delivering device according to claim 5, wherein the upper frame comprises a stopping releasing part to separate the stopping protrusion from the stopping groove when the upper frame is rotated from the driving position to the opening position.

7. The paper delivering device according to claim 1, further comprising a frame sensor to sense that the upper frame is positioned at the driving position, and a plate sensor to sense that the plate is disposed at the lower frame.

8. The paper delivering device according to claim 1, further comprising:

a supporting frame positioned at an upper side of the upper frame; and position maintaining parts, which are disposed at the upper frame and the supporting frame, respectively, to oppose each other and to support the upper frame when the upper frame is positioned at the opening position.

9. An image forming apparatus comprising a paper delivering device of the claim 1.

10. An image forming apparatus comprising a paper delivering device of the claim 2.

11. An image forming apparatus comprising a paper delivering device of the claim 3.

12. An image forming apparatus comprising a paper delivering device of the claim 4.

13. An image forming apparatus comprising a paper delivering device of the claim 5.

14. An image forming apparatus comprising a paper delivering device of the claim 6.

15. An image forming apparatus comprising a paper delivering device of the claim 7.

16. An image forming apparatus comprising a paper delivering device of the claim 8.

* * * * *